US006639500B2

(12) United States Patent
Makino et al.

(10) Patent No.: US 6,639,500 B2
(45) Date of Patent: Oct. 28, 2003

(54) NONRECIPROCAL CIRCUIT DEVICE AND COMMUNICATION APPARATUS

(75) Inventors: Toshihiro Makino, Nagaokakyo (JP); Hiroki Dejima, Nagaokakyo (JP); Takashi Kawanami, Nagaokakyo (JP); Toshihiro Yamamoto, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 101 days.

(21) Appl. No.: 09/826,796

(22) Filed: Apr. 5, 2001

(65) Prior Publication Data

US 2001/0048358 A1 Dec. 6, 2001

(30) Foreign Application Priority Data

Apr. 5, 2000 (JP) ..... 2000-103439

(51) Int. Cl.[7] ..... H01F 5/00
(52) U.S. Cl. ..... 336/200; 336/192; 333/1.1
(58) Field of Search ..... 333/1.1, 24.2; 336/83, 65, 200, 232, 192

(56) References Cited

U.S. PATENT DOCUMENTS 5,608,262 A 3/1997 Degani et al.
5,608,361 A 3/1997 Makino et al. ..... 333/1.1
5,646,828 A 7/1997 Degani et al.
5,945,887 A 8/1999 Weiss et al. ..... 333/1.1

FOREIGN PATENT DOCUMENTS

| | | |
|---|---|---|
| EP | 0859484 | 8/1998 |
| JP | 52-171246 | 12/1977 |
| JP | 53-117139 | 9/1978 |
| JP | 6-164212 | * 6/1994 |
| JP | 2000101310 | 4/2000 |

* cited by examiner

*Primary Examiner*—Tuyen T. Nguyen
(74) *Attorney, Agent, or Firm*—Keating & Bennett, LLP

(57) ABSTRACT

The present invention provides a nonreciprocal circuit device which allows the relationship between the input and the output to be reversed using the identical terminal layout on a mounting substrate, only by preparing for a single type of nonreciprocal circuit device, and also provides a communication apparatus using this nonreciprocal circuit device. In this reciprocal circuit device, a plurality of centeral conductors are disposed on a ferrite on which DC magnetic field is to be applied, in a state of intersecting one another, matching capacitors are each connected between the ports of the centeral conductors and grounds, and a terminating resistor is connected between a predetermined port and a ground. In a resin case 7, input/output terminals which are conductively connected to the respective ports are disposed at substantially rotation-symmetrical positions with respect to the center of the bottom surface of the resin case.

3 Claims, 6 Drawing Sheets

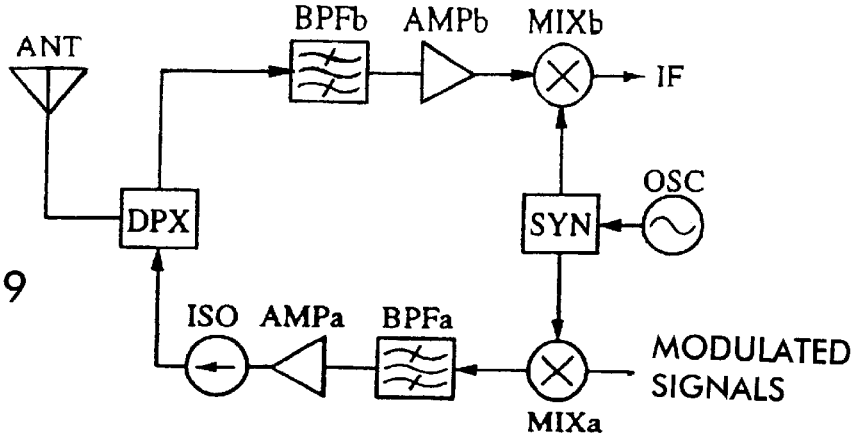
FIG. 9
FIG. 10 A PRIOR ART
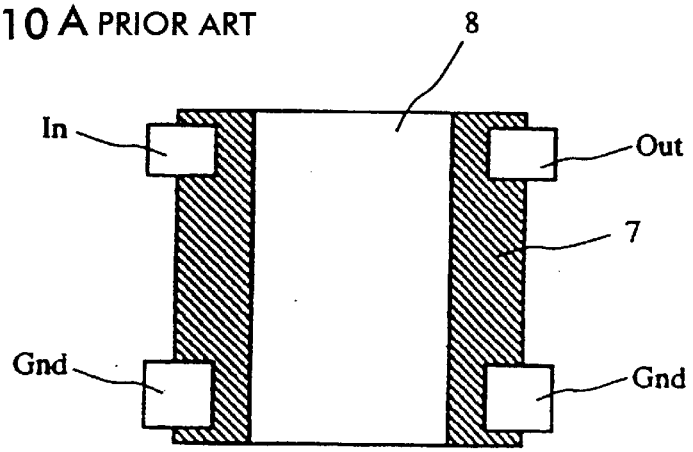
FIG. 10 B PRIOR ART
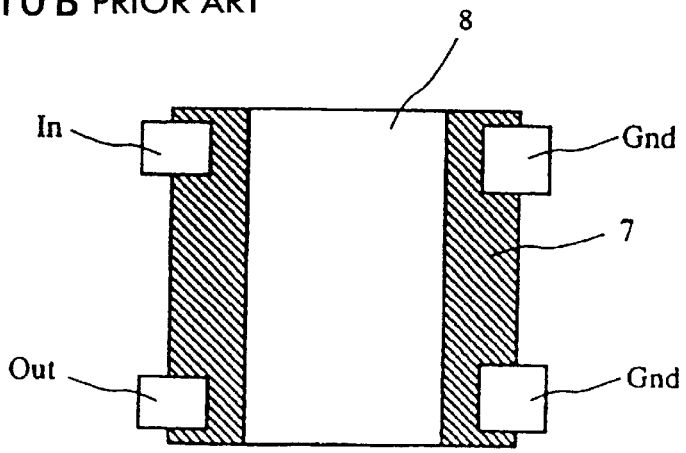

NONRECIPROCAL CIRCUIT DEVICE AND COMMUNICATION APPARATUS

BACKGROUND OF THE INVENTION

1. Field of the Invention

The present invention relates to a nonreciprocal circuit device, for example, an isolator, used in a high-frequency band such as a microwave band, and further to a communication apparatus using this nonreciprocal circuit device.

2. Description of the Related Art

Hitherto, a conventional lumped-constant type circulator has been formed by accommodating, in a case, a plurality of centeral conductors which is disposed adjacent to a ferrite plate so as to intersect each other, and a magnet for applying a DC magnetic field to a ferrite plate. On the other hand, the isolator has been formed by terminating a predetermined port among three ports, by a resistor.

FIGS. 10A and 10B are bottom views showing two types of conventional isolators. Here, a lower yoke 8 doubling as a lower case, a resin case 7, an input terminal In, an output terminal Out, and a ground terminal Gnd are shown.

As shown in FIG. 10, in a conventional isolator, both of the input terminal and output terminal have been disposed along one side in the longitudinal or transverse direction, of the resin case 7. As a result, the directivity of the input/output of the isolator has been determined in advance. Hence, when attempting to reverse the positional relation of the signal input and signal output in the case where the isolator has been mounted on a circuit board of electronic equipment such as a communication apparatus, it has been necessary to replace this isolator with an isolator which is opposite thereto in the nonreciprocal characteristics of input/output. Of course, the nonreciprocal characteristics of input/output can be reversed by reversing the polarity of a DC magnetic field which is applied to the ferrite plate. However, it is very difficult and quite unrealistic that users reverse the polarity of the magnet and performs adjustment of the characteristics of the isolator.

On the other hand, the manufacturer of the isolators is required to prepare beforehand for two types of isolators which differ in the direction of input/output from each other, in order to meet the request from users. This causes an increase in the cost of production and management.

SUMMARY OF THE INVENTION

Accordingly, it is an object of the present invention to solve the above-described problems, and to provide a nonreciprocal circuit device which allows the relationship between the input and the output to be reversed using the identical terminal layout on a mounting substrate, only by preparing for a single type of nonreciprocal circuit device, and further to provide a communication apparatus using this nonreciprocal circuit device.

In accordance with the present invention, there is provided a nonreciprocal circuit device comprising a magnetic body on which a DC magnetic field is applied, and a centeral conductor disposed adjacent to the magnetic body. In this nonreciprocal circuit device, input/output terminals connected to the centeral conductor are disposed at substantially rotation-symmetrical positions with respect to substantially the central portion of the bottom surface of the nonreciprocal circuit device.

The described features allow the direction of nonreciprocal characteristics of input/output to be reversed only by rotating the nonreciprocal circuit device by substantially 180° along the plane of the bottom thereof. Therefore, only by preparing for a single type of nonreciprocal circuit device, the directivity of input/output can be determined when the nonreciprocal circuit device is mounted on a circuit board of electronic equipment such as a communication apparatus.

In the present invention, it is preferable that a plurality of ground terminals connected to the centeral conductor be provided, and that the ground terminals be disposed at substantially rotation-symmetrical positions with respect to the substantially central portion of the bottom surface of the nonreciprocal circuit device. These features allow the ground connection between the ground terminals of the nonreciprocal circuit device and the ground electrodes on the mounting substrate to be established with a reliability, irrespective of the mounting state of the nonreciprocal circuit device on a mounting substrate.

The present invention further provides a communication apparatus including above-described nonreciprocal circuit device.

The above and other objects, features, and advantages of the present invention will be clear from the following detailed description of the preferred embodiments of the invention in conjunction with the accompanying drawings.

BRIEF DESCRIPTION OF THE DRAWINGS

FIG. 9 is a block diagram showing the configuration of a communication apparatus in accordance with a seventh embodiment of the present invention; and FIG. 10 is a bottom view showing the configuration of a conventional isolator.

DESCRIPTION OF THE PREFERRED EMBODIMENTS

The configuration of an isolator in accordance with a first embodiment will be described with reference to FIGS. 1 to 3.

Figure 1:
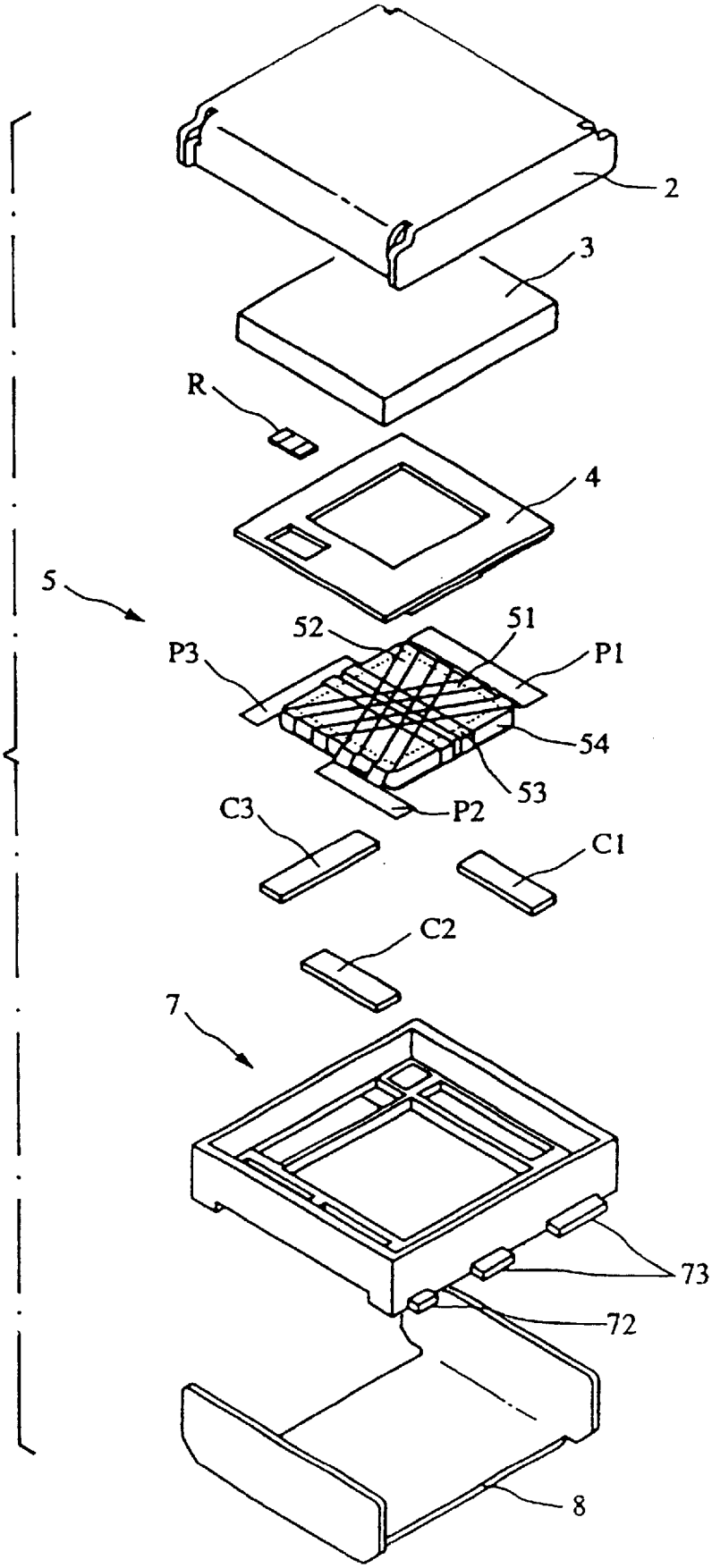
FIG. 1 is an exploded perspective view showing an isolator in accordance with a first embodiment of the present invention.
Figure 2:
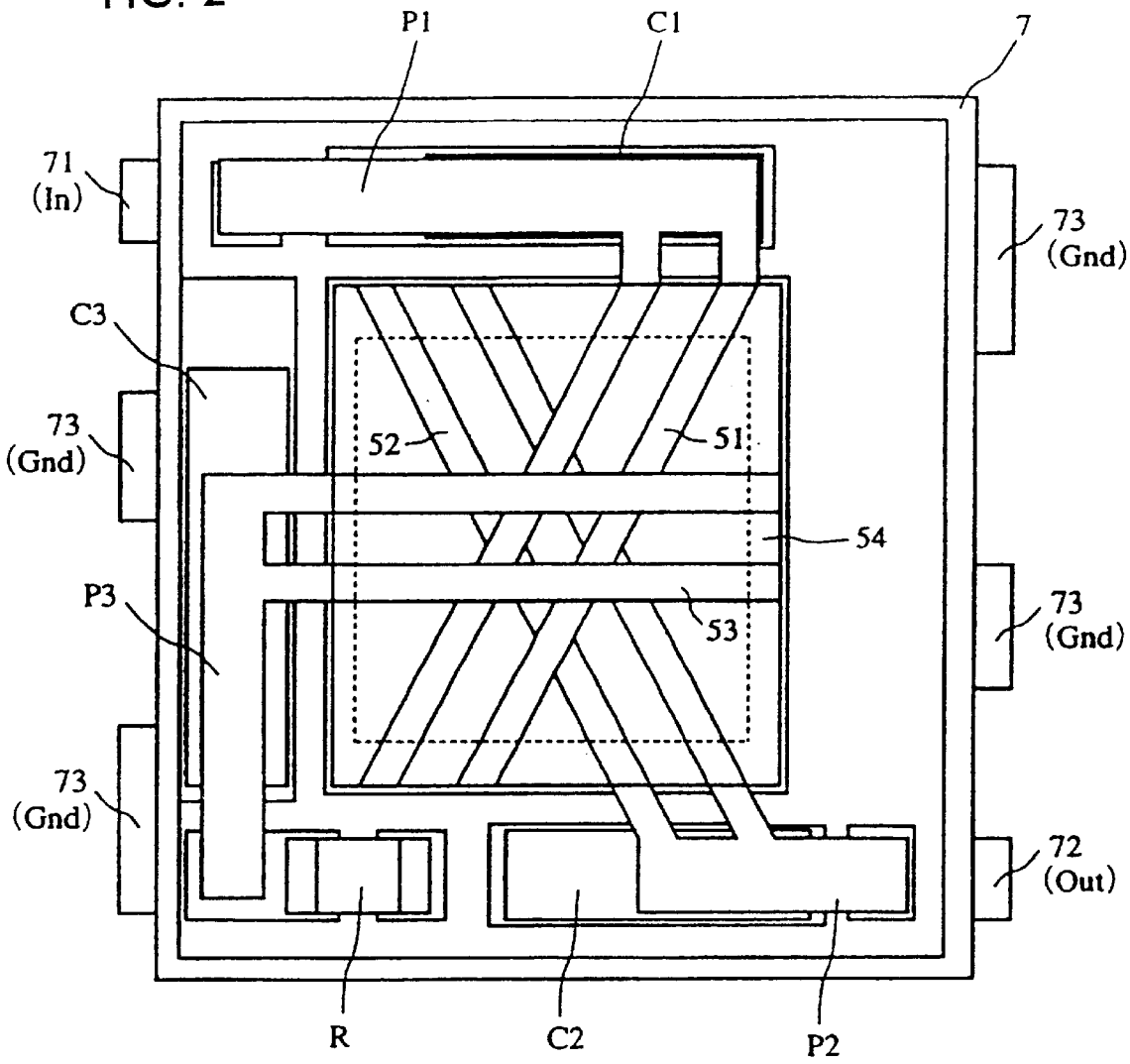
FIG. 2 is a top view showing the isolator in accordance with the first embodiment, wherein an upper yoke and a lower yoke have been removed.

FIG. 1 is an exploded perspective view of the isolator, and FIG. 2 is a top view of the isolator wherein an upper yoke 2 and a lower yoke 8 have been removed. Here, the upper yoke 2 is a box-shaped one which is made of a magnetic metal. A rectangular-plate-shaped permanent magnet 3 is disposed on the inner surface of the upper yoke 2. In a magnetic assembly 5, a ferrite 54 is disposed on the coupling portion of centeral conductors, the coupling portion having substantially the same shape as that of the bottom surface of the ferrite 54. The three centeral conductors 51, 52, and 53 which extend from the coupling portion are folded so as to wrap the ferrite 54 with insulating sheets (not shown) interposed therebetween, and to intersect one another at an angle of about 120°. The port portions P1, P2, and P3 on the tip sides of the respective centeral conductors 51, 52, and 53 are projected outward. A spacer 4 is provided for keeping the gap between the magnetic assembly 5 and the permanent magnet 3 at a predetermined spacing. A ground electrode, a portion of which is exposed to an inner upper surface of a resin case 7, an input/output terminal 72, ground terminals 73, each of which are exposed from the bottom surface to side surfaces of the case, and the like are insert-molded in this resin case 7. A matching capacitor C1 is connected between the port P1 and the ground electrode in the resin case 7, and likewise, matching capacitors C2 and C3 are connected between the port portions P2, and P3, and the ground electrodes in the resin case 7, respectively. A terminating resistor R is connected between the electrode thereof electrically connected to the port P3 and the ground electrode. The lower yoke 8 made of a magnetic metal forms a closed magnetic circuit in combination with the upper yoke 2. The magnetic field by the permanent magnet 3 is thereby applied to the ferrite 54 in the thickness direction thereof.

Figure 3:
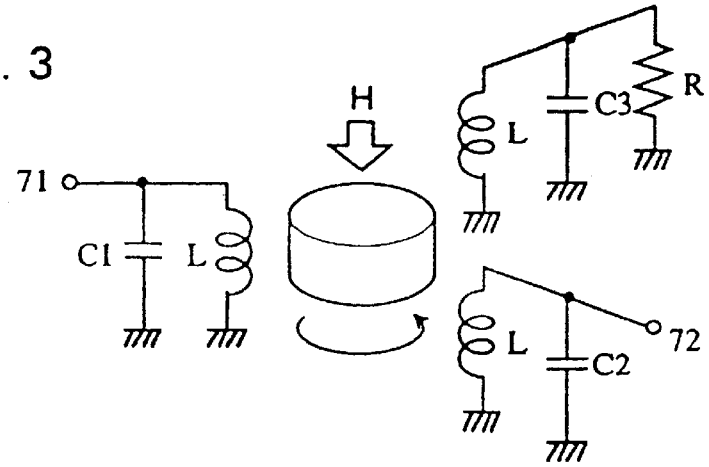
FIG. 3 is an equivalent circuit diagram for the isolator in accordance with the first embodiment.

FIG. 3 is an equivalent circuit diagram for the above-described isolator. In FIG. 3, an equivalent inductor L is formed by each of the centeral conductors 51, 52, and 53 and the ferrite. The capacitance of each of the capacitors C1, C2, and C3 is arranged so as to be matched with the inductance of the above-mentioned inductor L, and to thereby achieve a low insertion-loss characteristics over a predetermined bandwidth around a predetermined central frequency. Reference numeral 71 denotes an input terminal, and numeral 72 an output terminal. Signals supplied from the input terminal 71 is outputted from the output terminal 72. On the other hand, signals inputted to the output terminal 72 is hardly transmitted to the input terminal 71 side, and are terminated by the resistor R.

As shown in FIG. 2, since the input/output terminals 71 and 72 are disposed at rotation-symmetrical positions with respect to the center of the bottom surface of the resin case 7, the positional relation between the input/output terminals 71 and 72 is reversed, by rotating the nonreciprocal circuit device by substantially 180° from the arrangement shown in FIG. 2, along the bottom surface of the resin case. This allows the directivity of the isolator to be reversed. Also, in this example, by disposing four ground terminals 73 at rotation-symmetrical positions with respect to the center of the bottom surface of the resin case, the positions of these ground terminals can be made to remain unchanged even when the isolator has been rotated by 180° with respect to the arrangement shown in FIG. 2. Thereby, when mounting the isolator on a mounting substrate, the connection between the ground terminal of the isolator and the ground electrode on the mounting substrate can be securely established whichever posture the isolator may take.

Next, the configurations of isolators in accordance with second to six embodiments will be described with reference to FIGS. 4 to 8 as bottom views.

In these figures, reference character In denotes an input/output terminal used as an input terminal for forward signals, reference character Out denotes an input/output terminal used as an output terminal for forward signals, and Gnd denotes a ground terminal. Reference numeral 7 denotes a resin case, 8 denotes a lower yoke.

Figure 4:
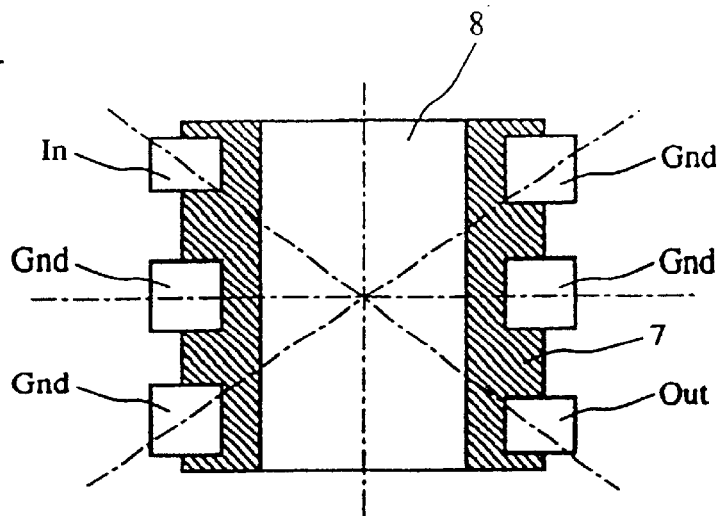
FIG. 4 is a bottom view showing the isolator in accordance with a second embodiment of the present invention.

In the embodiment shown in FIG. 4, two sets of input/output terminal and ground terminals are each arranged on two opposed sides of the resin case, and the pitches of these terminals are set to be substantially equal. The width of each of the input/output terminals are made smaller than that of each of the ground terminals so that the positions of the input/output terminals can be easily read visually or by an automation machine.

Figure 5:
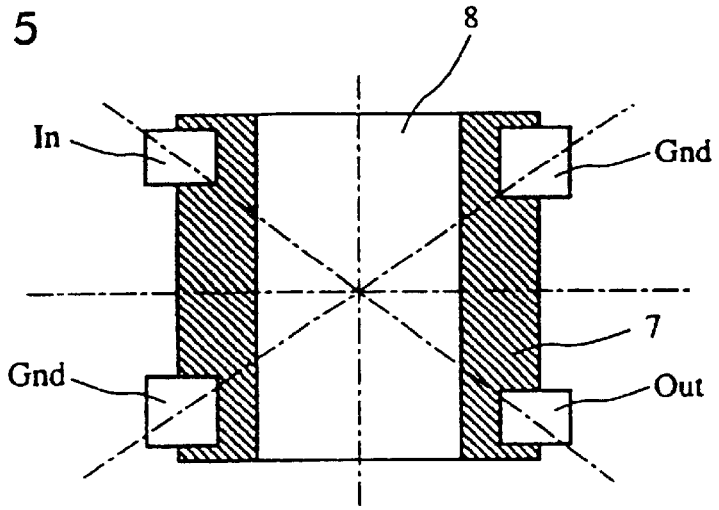
FIG. 5 is a bottom view showing the isolator in accordance with a third embodiment of the present invention.

The embodiment shown in FIG. 5 has a four-terminal configuration wherein input/output terminals are arranged at positions on one diagonal line, and a pair of ground terminals are arranged at positions on the other diagonal line.

Figure 6:
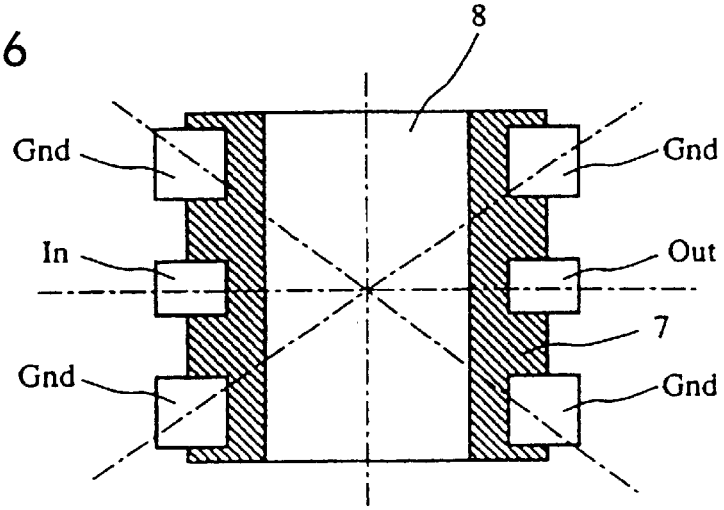
FIG. 6 is a bottom view showing the isolator in accordance with a fourth embodiment of the present invention.

In the embodiment shown in FIG. 6, two pairs of ground terminals are arranged on both sides of the input/output terminals. This facilitates the connection to a coplanar line which is formed by providing ground electrodes on both sides of a centeral conductor.

Figure 7A:
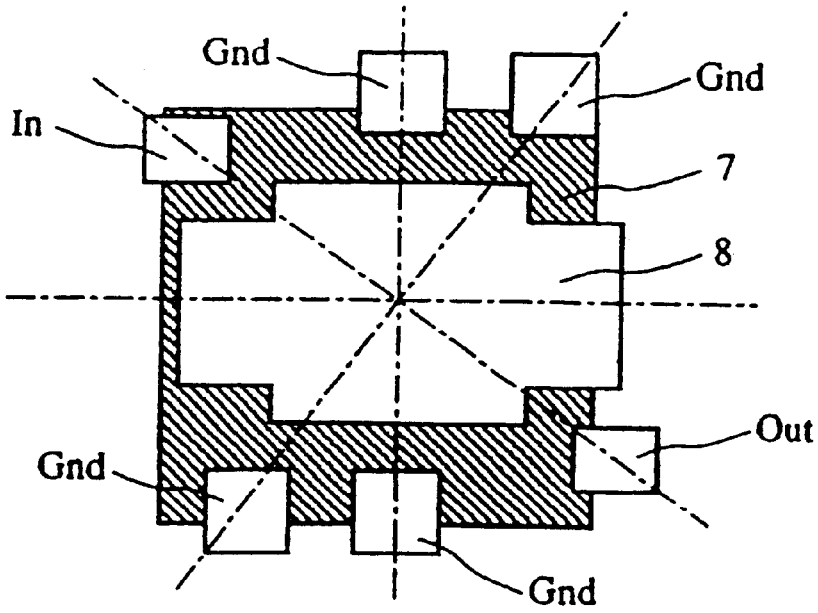
FIG. 7 is a bottom view showing the isolator in accordance with a fifth embodiment of the present invention.

In the embodiment shown in FIG. 7A, input/output terminals and ground terminals are arranged on the four sides of the bottom surface of the resin case 7. In this case, unlike the isolators of the above-described embodiments, input/output terminals and ground terminals are disposed at rotation-symmetrical positions with respect to the position slightly deviated from the correct center position on the bottom surface of the resin case.

Figure 7B:
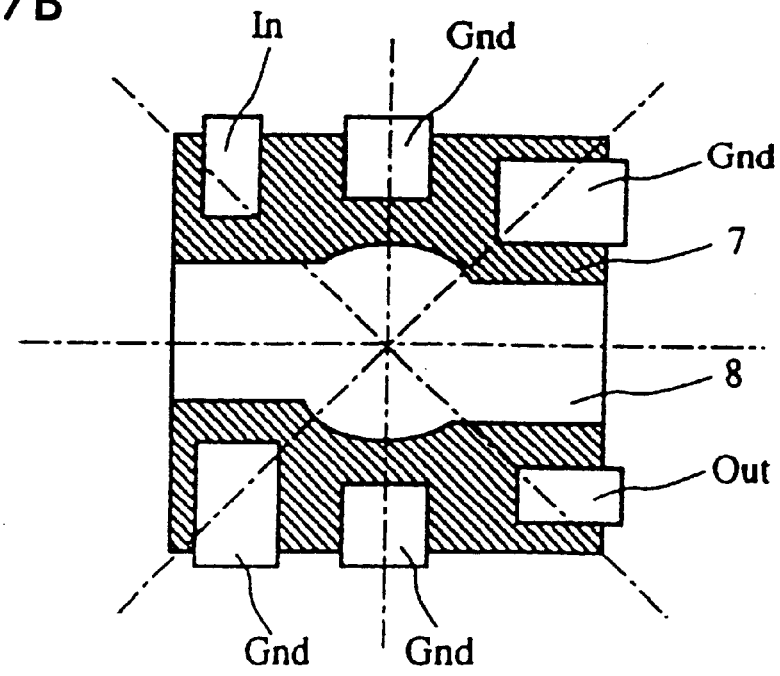

In the embodiment shown in FIG. 7B, the outwardly projecting directions of input/output terminals and ground terminals when the isolator has been rotated by 180°, differ from the outwardly projecting directions in the posture shown in FIG. 7B. However, the input/output terminals and the ground terminals are arranged at substantially rotation-symmetrical positions with respect to the center of the bottom surface of the resin case.

Figure 8A:
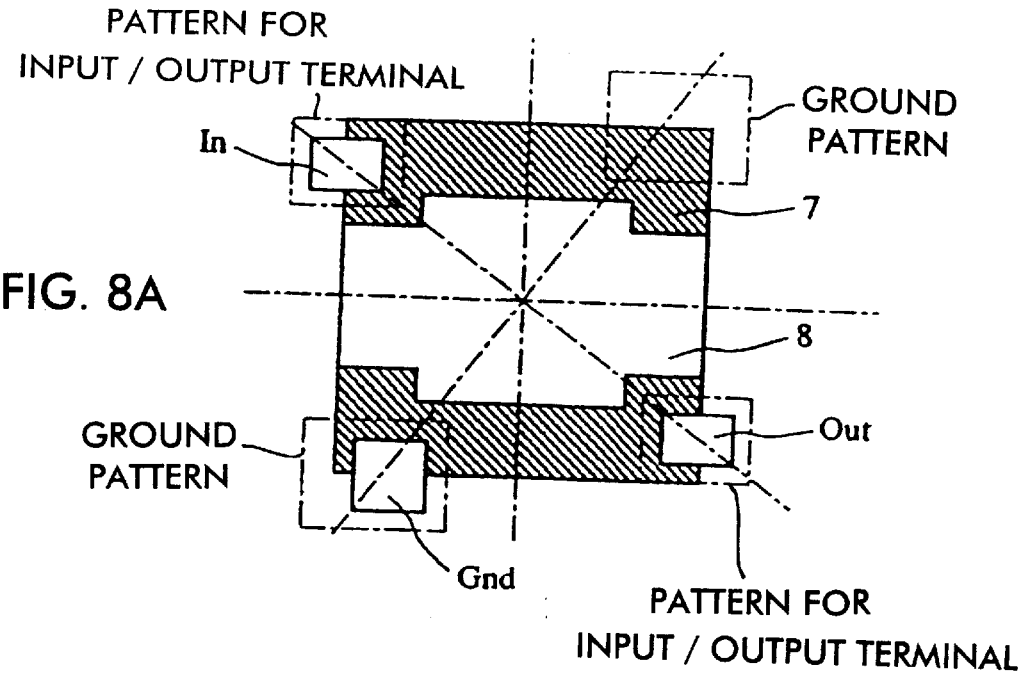
FIG. 8 is a bottom view showing the isolator in accordance with a sixth embodiment of the present invention.

In the embodiment shown in FIG. 8A, input/output terminals are provided at rotation-symmetrical positions, and a single ground terminal is provided. Even though the isolator has such a configuration, by providing a mounting substrate with ground patterns (ground electrodes) at two possible positions to which the ground terminal of the isolator is electrically connected, ground connection can be established in both cases of the posture of the isolator shown in FIG. 8A, and the posture thereof when the isolator of FIG. 8A has been rotated by 180°.

Figure 8B:
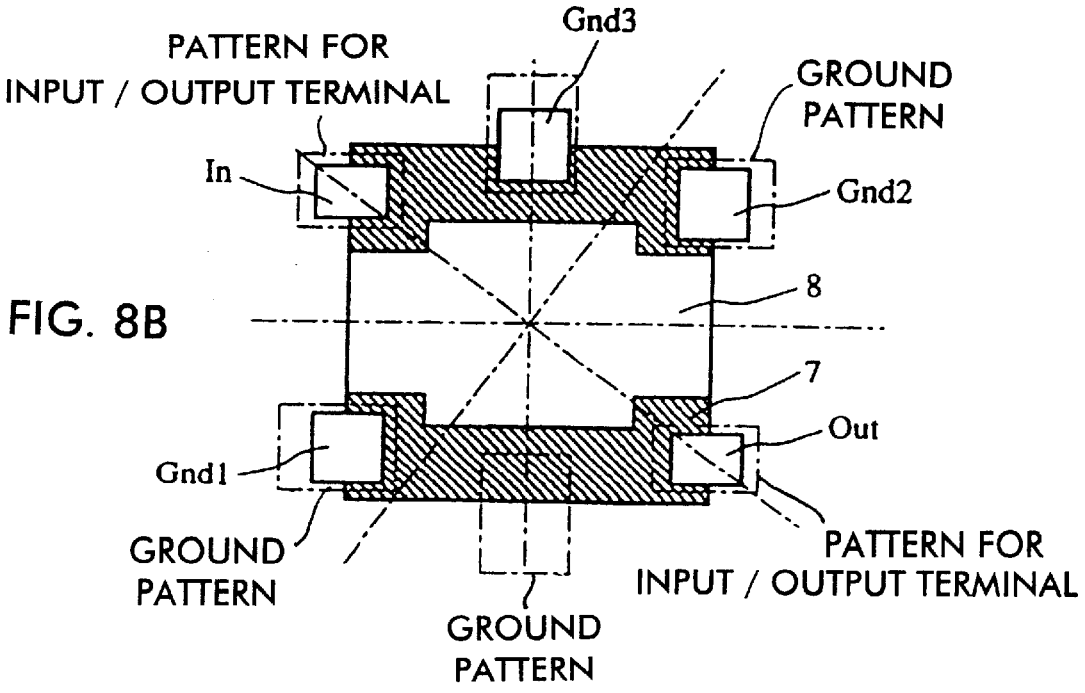

In the example shown in FIG. 8B, ground terminals Gnd1 and Gnd2 are provided at rotation-symmetrical positions, and apart from these, a single ground terminal Gnd3 is provided. In this case also, by providing a mounting substrate with a ground pattern which is to be electrically connected to the ground terminal Gnd3 when rotated by 180°, ground connection can be established at the three points, irrespective of the posture which the isolator takes.

In the above-described embodiments, the input/output terminals and the ground terminals are provided within the resin case. However, the present invention may be applied to, for example, a nonreciprocal circuit device wherein electrodes formed on the mounting substrate are used as input/output terminals and ground terminals, instead of providing these terminals within the case.

Also, in each of the above-described embodiments, the nonreciprocal circuit device has been described taking, as an example, a lumped-constant type nonreciprocal circuit device wherein a plurality of centeral conductors are disposed adjacent to a magnetic body so as to intersect each other in which the conductors are insulated with each other. However, the present invention may be applied to a distributed-constant type nonreciprocal circuit device represented by a strip line type wherein a Y-shaped centeral conductor is disposed between two magnetic bodies, or a microstrip line type wherein a Y-shaped centeral conductor is disposed on one magnetic body.

Next, an example of communication apparatus using the above-described isolator will be described with reference to FIG. 9. In FIG. 9, reference character ANT denotes a transmitting/receiving antenna, DPX a duplexer. BPFa and BPFb each denote band pass filters, AMPa and AMPb amplifier circuits, and MIXa and MIXb mixers. OSC denotes an oscillator, and SYN a frequency synthesizer. MIXa modulates frequency signals outputted from SYN with modulation signals, BPFa passes only the transmission frequency band, and AMPa power-amplifies these signals and transmits them from ANT via an isolator ISO and DPX. BPFb passes only the reception frequency band among the signals transmitted from DPX, and AMPb amplifies the passed signals. MIXb mixes the frequency signals outputted from SYN and the received signals, and outputs intermediate frequency signals IF. In a communication apparatus having such configuration, a nonreciprocal circuit device as shown in FIGS. 1 to 8 is employed as the above-described isolator ISO.

As in evident from the foregoing, in accordance with the present invention, the direction of nonreciprocal characteristics of input/output can be reversed only by rotating the nonreciprocal circuit device by substantially 180° along the plane of the bottom thereof. Therefore, if only a single type of nonreciprocal circuit device is prepared for, the directivity of input/output can be determined only by determining a mounting posture of a nonreciprocal circuit device, when the nonreciprocal circuit device is mounted on a circuit board of electronic equipment such as a communication apparatus. This results in an reduction in the overall cost.

Furthermore, in accordance with the present invention, the ground connection between the ground terminals of the nonreciprocal circuit device and the ground electrodes on the mounting substrate can be established with a reliability, irrespective of the mounting state of the nonreciprocal circuit device on a mounting substrate.

Moreover, in the communication apparatus in accordance with the present invention, an overall cost reduction can be achieved by using the low-cost nonreciprocal circuit device in accordance with the present invention. In addition, since circuitry is configured on a predetermined location using a single type nonreciprocal circuit device, the apparatus design is facilitated.

While the present invention has been described with reference to what are at present considered to be the preferred embodiments, it is to be understood that various changes and modifications may be made thereto without departing from the invention in its broader aspects and therefore, it is intended that the appended claims cover all such changes and modifications as fall within the true spirit and scope of the invention.

What is claimed is:

1. A nonreciprocal circuit device, comprising:

a magnetic body on which a DC magnetic field is applied; and a central conductor disposed adjacent to said magnetic body, wherein input/output terminals connected to said central conductor are disposed at substantially rotation-symmetrical positions with respect to a central portion of the bottom surface of said nonreciprocal circuit device.

2. A nonreciprocal circuit device in accordance with claim 1, further comprising:

a plurality of ground terminals connected to said central conductor, wherein said plurality of ground terminals are disposed at substantially rotation-symmetrical positions with respect to the central portion of the bottom surface of said nonreciprocal circuit device.

3. A communication apparatus including a nonreciprocal circuit device in accordance with claim 1 or 2.

* * * * *